United States Patent [19]

Barker

[11] Patent Number: 4,998,477

[45] Date of Patent: Mar. 12, 1991

[54] DETONATION TRANSFER APPARATUS FOR INITIATING DETONATION OF AN INSENSITIVE DETONATING CORD UTILIZING AN INITIATING COMPOUND, FLYER AND SHOCK REFLECTOR

[75] Inventor: James M. Barker, Katy, Tex.

[73] Assignee: Halliburton Logging Services, Inc., Houston, Tex.

[21] Appl. No.: 480,195

[22] Filed: Feb. 14, 1990

[51] Int. Cl.[5] ..... F42C 19/12; F42B 19/08; F42D 1/04

[52] U.S. Cl. ..... 102/275.6; 102/202.5

[58] Field of Search ..... 102/202.5, 275.1-275.2, 102/275.3, 275.4, 275.6, 275.7

[56] References Cited

U.S. PATENT DOCUMENTS

| | | | |
|---|---|---|---|
| 2,889,773 | 6/1959 | Staadt et al. | 102/275.5 |
| 3,180,264 | 4/1965 | Webb | 102/275.4 |
| 3,238,876 | 3/1966 | Allen | 102/275.4 |
| 3,460,477 | 8/1969 | Heidemann et al. | 102/275.2 |
| 3,945,322 | 3/1976 | Carlson et al. | 102/275.4 |
| 4,314,508 | 2/1982 | Love | 102/275.3 |
| 4,423,682 | 1/1984 | Schimmel | 102/275.2 |
| 4,612,857 | 9/1986 | Schimmel | 102/275.2 |
| 4,759,291 | 7/1988 | Barker et al. | 102/202.5 |
| 4,920,883 | 5/1990 | Barker | 102/202.5 |

*Primary Examiner*—David H. Brown

*Attorney, Agent, or Firm*—William J. Beard

[57] ABSTRACT

An improved detonation transfer apparatus is set forth. In one embodiment, it incorporates a transverse bulkhead having selected explosive materials on both sides thereof. The bulkhead is shaped into a concave lens to focus the shock wave toward a focal point so that one of the explosive materials directs a shock wave into the other of the explosive materials, thereby triggering sufficient shock wave pressure for detonation. In an alternate embodiment, a blasting cap transfers detonation to a first secondary explosive material which forms a flyer; the flyer travels across the space, impacting with a metal transverse bulkhead which in turn transfers a shock wave through the bulkhead into another explosive shaped in the form of a pellet. This has a high impedance reflector plate in it. The reflector plate is approximately parallel to the transverse bulkhead so that shock wave reflection occurs at the plate and further increases shock wave pressure, thereby exceeding the levels necessary for detonation, and detonation is thereby transferred into the detonating cord.

13 Claims, 3 Drawing Sheets

FIG. 3
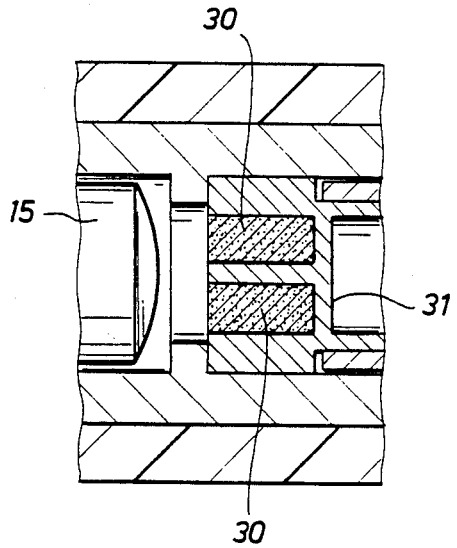
FIG. 4
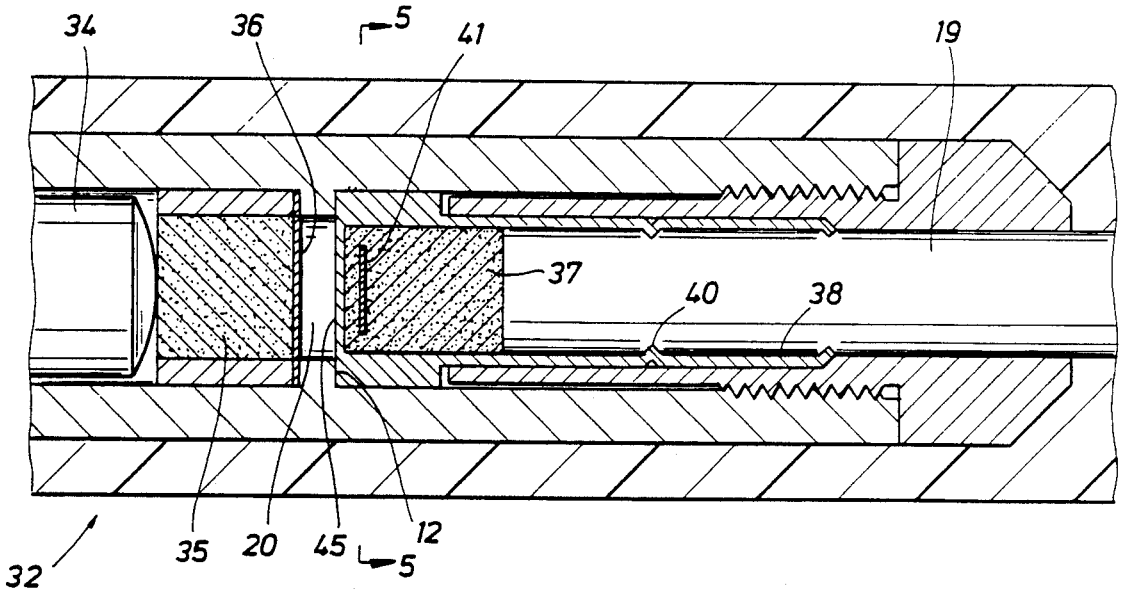
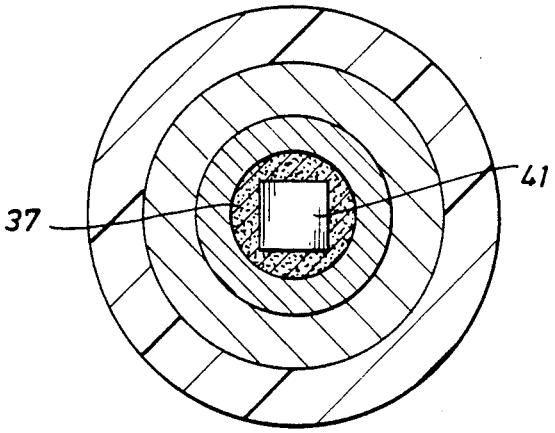
FIG. 5

DETONATION TRANSFER APPARATUS FOR INITIATING DETONATION OF AN INSENSITIVE DETONATING CORD UTILIZING AN INITIATING COMPOUND, FLYER AND SHOCK REFLECTOR

BACKGROUND OF THE DISCLOSURE

Recently issued U.S. Pat. No. 4,759,291 sets forth a device for initiating detonation of a detonating cord. The present disclosure is directed to improvements for use in a deep well detonation system. It is particularly intended for use in deep oil or gas wells where perforations are normally formed into the adjacent producing formations. The perforations involve several explosive components, the explosive train typically including a firing pulse generator (FPG), a detonator, a connected detonating cord and one or more shaped charges. The shaped charges are spaced along the tool which supports all of this equipment. Dependent on the location of the well and other factors, the explosive equipment may be exposed to temperatures as high as about 500° F. at ambient pressures in excess of 20,000 psi. Clearly, this high temperature and pressure places an extraordinary stress on the explosive train, and particularly on the detonating cord which is encased circumferentially in a jacket and where the explosive in the cord is subjected to both high temperature and pressure. In general terms, elevated temperature and pressure is detrimental to the explosive components. That is, the components degrade as a function of temperature and pressure. It is necessary to utilize only thermally stable explosive compounds in the explosive train. Representative compounds are PYX or ONT, two explosives which have excellent thermal stability. These explosive materials are relative easy to manufacture and are reasonable cost products. They have excellent thermal stability and are able to tolerate temperatures as high as 500° F. for 100 hours. Generally, there are limits to all explosive materials because they are subject to accelerated degradation when exposed to high pressures and temperatures.

It has been ascertained that a detonating cord made from these explosives is highly desirable, but one of the features which makes it highly desirable also makes it difficult to detonate. Important features involved in the design of an explosive train featuring such a detonating cord include the inherent thermal stability of these reactive materials; this yields an explosive train which is quite insensitive both to heat and shock. This insensitivity increases the requirements necessary to detonate such explosives. Moreover, the extraordinary pressures encountered in deep boreholes increase the packing or density of the explosive materials inside the detonating cord and thereby decreases sensitivity. Also, the particle size of the explosive material which is most suitable for detonating cord fabrication is not conducive to easy initiation. As a clear result of these conflicting requirements, the detonating cords made of such thermally stable explosive materials when installed in a downhole environment are extremely difficult to initiate.

Conventional detonators do not provide adequate shock strength for initiation of such detonation cords. The detonator which is set forth in the referenced patent may well encounter difficulty in initiating an explosive cord in such circumstances. The apparatus in accordance with the teachings of the present disclosure overcomes these and other limitations. It is desirable to provide a crimped structure that affixes to the end of a detonating cord and which has a transverse barrier which prevents the end of the detonating cord from being extruded when subjected to extraordinarily high pressures. This barrier is incorporated for the express purpose of confining the detonating cord. However, the imposition of a barrier across the housing impedes detonation shock wave transfer to the detonating cord. The present disclosure sets out a device which overcomes transfer problems associated with a transverse barrier. Another important feature of the apparatus affixed to the detonating cord is the incorporation of a small cylinder or pellet of pressed secondary explosive material on one side of the barrier. When firing does occur, the secondary explosive assists in transferring the shock wave to the detonation cord through a transverse barrier. There are further means including a retainer shoulder for registration purposes and a surrounding peripheral crimp which is included to assure that the equipment holds together under such severe circumstances.

An important feature of the present disclosure is overcoming shock impedance mismatches involved in the relative changes of impedance to the shock wave transmitted through the barrier. The transverse barrier is preferably made of aluminum or similar metal for structural reasons; however, the shock wave which traverses a metal transverse member will inevitably lose shock pressure when thereafter directed into the adjacent detonating cord, a lower impedance material. The present disclosure contemplates a specially shaped and designed transverse barrier or bulkhead. That is, it is constructed in the form of a concave region to thereby define a concave lens. This lens system focuses the shock waves transmitted thereby, and the focused waves thus impinge after traversing the barrier in a specified region. Ideally, this region includes a relatively short cylindrical pellet of special explosives as will be set forth, and that in turn is abutted against the end of the detonating cord. This focusing arrangement works quite well to provide a boost in shock wave intensity. A further boost can be obtained by arranging three such pellets adjacent to the transverse bulkhead where each directs the shock wave along the axis of the crimped structure across the barrier, and then overlapping in a common focal region. Thus, three such pellets can be used wherein each forms its own shock wave which is transmitted across the transverse bulkhead; the shock waves formed thereby overlap in an adjacent region. As all the shock wave energy is brought to that region, the shock impulse necessary to accomplish detonation is thereby achieved. One feature is the secondary explosive initiating compounds are located at or in the region of the converging shock waves so that they, notwithstanding their extraordinary stability, are initiated properly and then convey the initiation shock wave to an adjacent detonating cord termination. This properly directs the explosive shock wave into the cord where it is desired.

In one particular embodiment of the present disclosure, there is a gap with an air space between, and a flyer or plate is propelled across the space to deliver a shock wave to the facing area. This flyer impact causes a shock wave of substantial amplitude. The shock wave is further magnified by incorporating a recessed, high impedance reflector plate within the initiating compound and adjacent to the end of the detonating cord. This forms a reflective surface which reflects a higher pressure wave, thereby increasing the shock level so that sufficient shock is present for detonation. The preferred and alternate embodiments will be described in detail hereinafter on review of the written specification in conjuction with the attached drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is an alternate construction of the transverse bulkhead shown in FIG. 2 which shows plural pellets of secondary explosive wherein each pellet is cooperative with the others to direct the shock waves from the pellets toward a centralized region;

FIG. 4 is an enlarged view similar to FIG. 2 showing an alternate construction of a transverse bulkhead utilizing an embedded reflector plate;

FIG. 5 is a sectional view through the structure of FIG. 4 showing details of construction of the reflector plate.

DESCRIPTION OF THE PREFERRED EMBODIMENT

Figure 1:
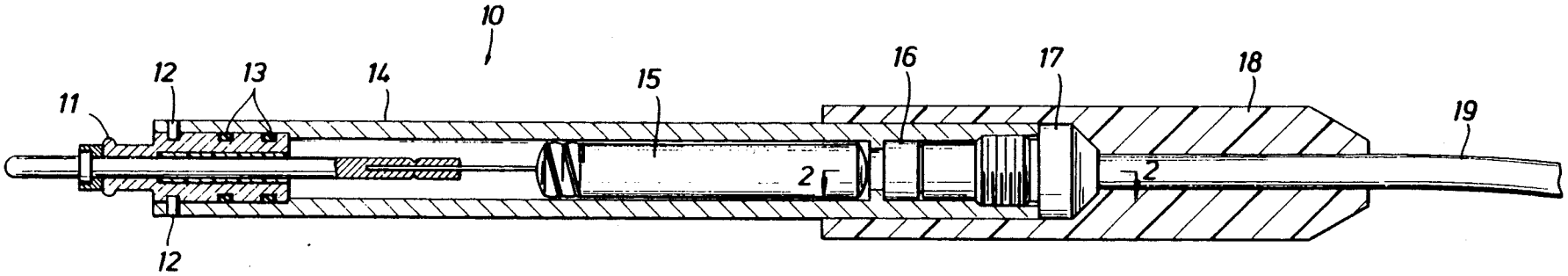
FIG. 1 is a sectional view through an explosive train arranged with appropriate conductor for delivery of a firing pulse thereto, and further shows a portion of a detonating cord which delivers the detonation to a plurality of shaped charges.

Attention is directed to FIG. 1 of the drawings where the numeral 10 identifies apparatus attached to one end of a detonating cord to provide detonation for a plurality of shaped charges. This is an explosive assembly which is normally installed in a tool lowered in a well borehole to form laterally directed perforations extending into the adjacent formations. The explosives in the explosive assembly 10 must be kept dry. Regrettably, they are used in a submerged circumstance, and are additionally exposed to high pressures and temperatures. Temperatures can reach 400° F., and occasionally even 500° F. Pressures can exceed 20,000 psi. In light of the ambient conditions, the reactive materials used in the structure must be substantially immune to thermal degradation. Several of the explosive materials discussed below have this virtue, but it is obtained at a severe cost, namely that the explosive material is substantially insensitive. As the explosive ingredients become more insensitive, they also become more difficult to initiate. To this end, the present apparatus provides a structure which is able to detonate the detonating cord, and thus, the shaped charges in a reliable and predictable fashion.

The foregoing must be accomplished in the presence of high ambient pressures. These pressures distort the structure 10, and the structure must therefore be held together in a fashion to be described. This distortion tends to pump or force the cross-sectional area of the detonating cord into the housing. It is blocked by the incorporation of a transverse bulkhead.

The present structure incorporates an electrical feedthrough 11 at one end which connects with an electrical line extending to a firing pulse generator located elsewhere. It is held in position by a retainer pin and seals against leakage with a set of surrounding O-rings 13. The pins 12 and O-rings 13 cooperate with a surrounding sealed housing 14. The housing 14 is a pressure resistant structure which is plugged at the left hand end by the electrical feedthrough 11 as previously mentioned. The electrical feedthrough includes a central conductor which connects through the structure to an explosive device 15. This is a blasting cap which responds to the electrical signal applied from the firing pulse generator through the feedthrough and it explodes when detonated. It responds to this electrical pulse by forming an explosion which is transferred to an internal sleeve means 16. The sleeve 16 is held in position by a retainer 17 which is located in a central axially drilled passage within the structure. A resilient material is formed into an external encircling, concentrically mounted boot 18 which holds the retainer at one end of the housing. The boot 18 seals against fluid intrusion. It also surrounds the illustrated end of the detonating cord 19.

Going now to the interior of the present apparatus, there is a compressed pellet of secondary explosive located at 20 in a recess or chamber which is surrounded by the adjacent shoulder 21. This is a transverse member which completely spans the axial passage. Moreover, it fills the housing and is abutted against a locking shoulder 22 which registers the apparatus at the time of assembly. In addition to this, the shoulder 21 is adjacent to an elongate skirt portion 23 which appends from that and extends along and on the exterior of the cord 19. They are joined together by means of an encircling crimp 24 which holds the skirt to the cord. The shoulder 21 supports a transverse bulkhead or diaphragm 25. The diaphragm 25 extends fully across the structure. It is thus immediately adjacent to the explosive at 20. It has a pair of spaced faces. Ordinarily, they would be manufactured with the faces parallel or at least substantially so within manufacturing tolerances. In this particular instance, a different arrangement is used. The two faces are arranged so that the more remote face from the explosive 20 is concave as indicated at 26. The concave face in conjunction with the planar face serves as a concave lens system. It directs the shock wave from the explosive 20 in a fashion to be described.

Immediately adjacent to the concave face 26, there is an additional explosive at 27. It is in the form of a cylindrical pellet at the end of the cord 19. The pellet 27 is often described as a thermally stable secondary explosive initiating compound. Representative explosives are:

(1) ABH: Azobis (2,2',4,4',6,6'-Hexanitrobiphenyl)
(2) DODECA: 2,2',2'',2''',4,4',4'', 4''',6,6',6'',6''' Dodecanitro-m, m'-quatraphenyl
(3) NONA: 2,2',2'',4,4',4'',6,6',6''-Nonanitroterphenyl
(4) TNTPB: 1,3,5-Trinitro-2,4,6-Tripicrylbenzene
(5) DPO: 2,5-Dipicryl-1,3,4-oxadiazole
(6) HNS: 2,2',4,4',6,6'-Hexanitrostilbene.

The secondary explosive initiating explosive compound 27 is arranged in the cylindrical area at the end of the cord 19. Preferably, it is made so that the particles are relatively fine and somewhat fluffy. This is typically different from the explosive installation in the cord. The small quantity of initiating compound is exposed to the incident shock wave from the explosive pellet 20. The shock wave would ordinarily radiate outwardly as a growing spherical wave front. However, after the wave traverses the metal transverse member, it is focused to a focal point that is in the region of the initiating compound 27. The incident shock wave is thus directed in the fashion of light or other wave transmissions toward a focal point area. This increases shock wave pressure and thereby assures detonation of the explosive 27. When it detonates, detonation is then readily coupled into the cord 19, and can then travel the length of the cord.

As described to this juncture, the structure is a fluid tight structure which has sufficient structural integrity to withstand the rugged down hole conditions. The explosives chosen and those exemplified in the list above are selected for thermal stability. The boot 18 secures the cord in cooperation with the retainer 17. Fluid is excluded from the interior so that the powder is kept dry. The electrical signal from the firing pulse generator initiates the explosive sequence; it begins with the electrical signal, and then is converted into a shock wave from the blasting cap 15, and then through detonation of the explosives at 20, 27 and finally the cord 19. The shock wave is focused so that initiation is more likely to occur.

Attention is now directed to FIG. 3 of the drawings which shows multiple pellets 30 where each pellet is substantially cylindrical in shape. The pellets are arranged adjacent to one another. They each have end faces which are arranged adjacent to separate transverse walls 31 and these pellets direct the emitted shock waves toward a common or shared focal region, which is along the axis of the sleeve. This focal region is thus exposed to convergent shock waves from the two or more pellets. In the preferred embodiment, three pellets are so arranged, each as a separate source and each pellet directs its contribution toward the common focal region. On convergence of the shock waves to the focal region, the pressure within the shock wave is so increased that initiation is made certain. In this particular embodiment, the incorporation of three parallel and relatively similar pellets yields a marked increase for proper detonation.

Attention is now directed to FIG. 4 of the drawings where the numeral 32 identifies a different sleeve construction from that shown in FIG. 1. The housing is substantially the same and in that sense, a detailed description of the housing will be omitted for the moment. Rather, FIG. 4 shows a structure which can be used at exceedingly high pressures and temperatures. It is particularly well made with the secondary explosive PYX which is relatively stable. It can be exposed to 500° F. for several hours and yet remain stable. The explosive PYX is a relatively inexpensive explosive material and can be used successfully in the explosive train of the present disclosure. Moreover, it can be pressed to comprise a pellet or alternately can be included in a detonating cord. The highly desirable thermal stability makes it extremely difficult to initiate. The structure shown in FIG. 1 utilizes a pellet which is in immediate, facial contact with the bulkhead which is required to transmit the detonating shock wave across the bulkhead into the detonating cord. The instantaneous pressure in the transmitted shock wave is primarily the function of the detonation pressure of the donor explosive. It is also a function of the physical properties of the material making up the transverse bulkhead. Perhaps some representative numbers will make this somewhat more clear. Consider a pellet made of PYX which generates typical detonation pressures of about 250 kilobars. The shock wave after transmission through a transverse aluminum bulkhead is delivered into the detonating cord at about 200 kilobars. Shock strength of 200 kilobars is insufficient to reliably detonate PYX. Accordingly, the impinging explosive shock wave must be enhanced so that detonation will result. Rather than use the contact approach shown in FIG. 1 wherein the pellet 20 is immediately in contact with the transverse bulkhead, the structure of FIG. 4 uses a detonation formed flyer and a suitable recessed shock wave reflector to provide shock wave pressures as high as about 550 kilobars at selected locations.

Figure 2:
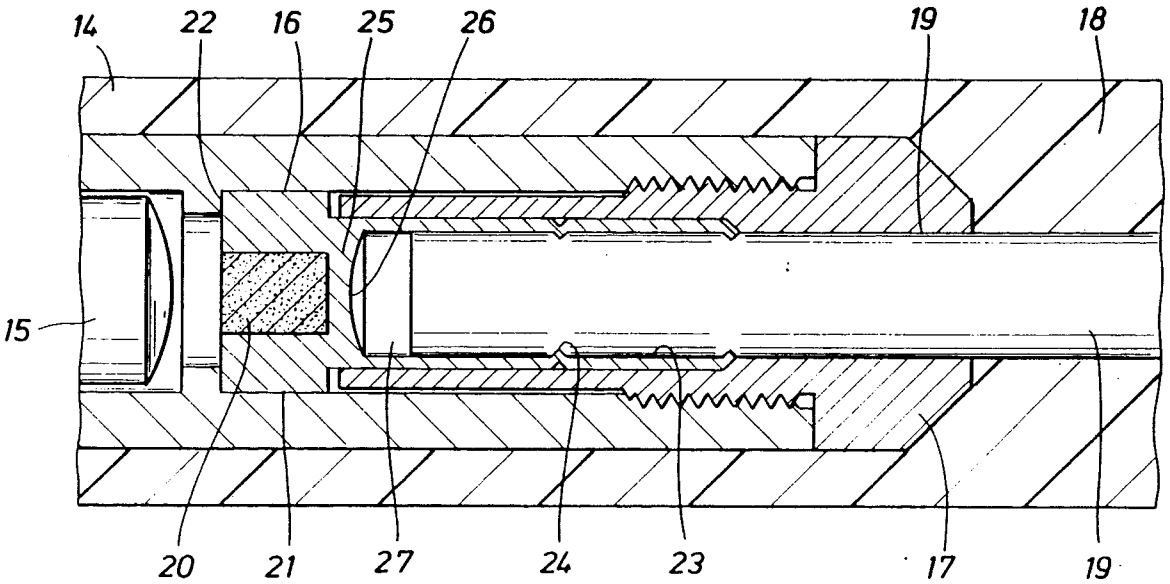
FIG. 2 is an enlarged sectional view of the device of FIG. 1 of the drawings showing additional details of construction of a transverse bulkhead cooperative with an initiator compound adjacent to the end of a detonating cord.

In the embodiment 32 shown in FIG. 4, there is a blasting cap 34 which is adjacent to a booster of secondary explosive 35. It is compressed or packed into a pellet. In turn, it is immediately adjacent to a metal flyer plate 36. This is a transverse plate immediately adjacent to the pellet and it is held in place by the same internally protruding registration shoulder 20 mentioned in FIG. 2 of the drawings. The secondary explosive is again formed in the shape of a cylindrical pellet 37 and that is located within the sleeve previously defined. The sleeve has a similar skirt portion 38 which incorporates an encircling crimp 40 for attaching to the detonating cord 19 received within the structure. Again, the housing and external boot remain the same. The explosive pellet 37 has an internal recessed reflector plate 41. The pellet 37 is enclosed within the surrounding cylindrical sleeve means, and is also sealed across the end face by a thin sheet of metal 45. The metal barrier prevents pressure of the borehole from extruding the detonating cord into the housing. The pellet 37 is adjacent the terminal end of the detonating cord 19. This particular embodiment operates in the following fashion. The blasting cap 34 is detonated, and that in turn causes initiation of the pellet 35. That forms a flyer which is an approximately round divot cut out of the flyer plate 36. It travels to the right and strikes the transverse member 45. This delivers a shock wave which is directed into the pellet 37. The shock wave is normally not sufficient to initiate the pellet 37 which is extraordinarily stable and difficult to start. However, the shock wave is reflected by the reflector plate 41 for shock wave enhancement. In regions adjacent to the reflector plate, the incident and reflective wave fronts add or reenforce and thereby raise the instantaneous shock wave pressure to an adequate level. It has been estimated that shock levels around 500–600 kilobars can be achieved. This is sufficiently high to cause detonation of the material 37 and thereby initiate the detonating cord 19. One of the details of the reflector plate is illustrated in FIG. 5, and in particular, the plate 41 is clear of the surrounding side walls.

VELOCITY PRESSURE RESPONSE OF THE VARIOUS MATERIALS

Figure 6:
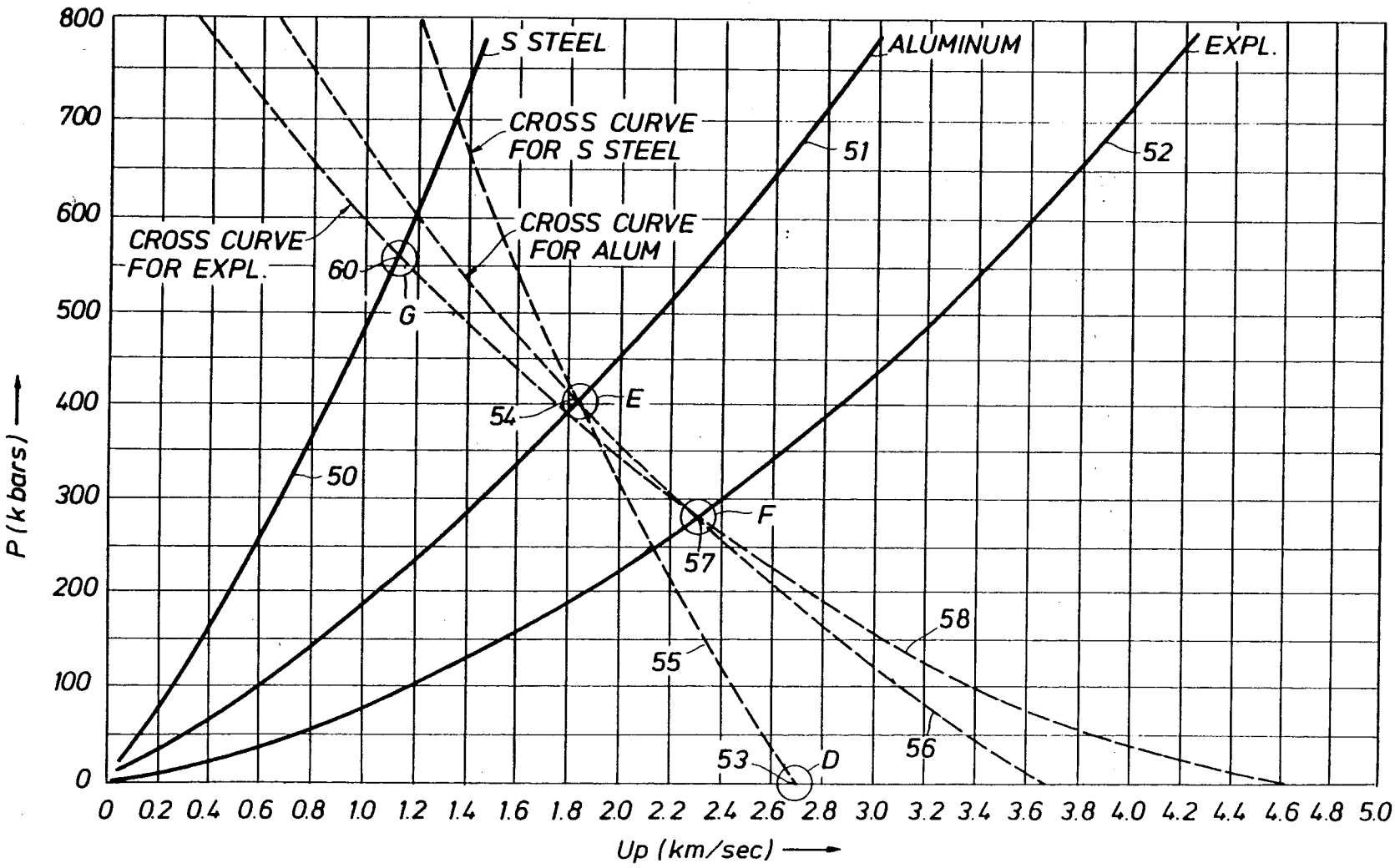
FIG. 6 is a graph of instantaneous shock wave pressure versus particle velocity in selected materials.

Going to the last of the drawings, there is a graph which shows certain curves which are important to an understanding of shock wave transmission and detonation of the extremely insensitive materials which make up the apparatus 32. The curve 50 relates the shock wave pressure and velocity for stainless steel. The curve 51 is for aluminum while the curve 52 is for the explosive material, more specifically PYX. The curves 50, 51 and 52 are the loci of possible state points (pressure and particle velocity) of right going shocks in their respective materials, and are known as Hugoniot curves. The curves 55, 56 and 58 are approximate mirror images of the curves 50, 51 and 52 and represent state points for left going shocks. Explosive Packing is presumed to a specified density. The curve will be shifted slightly if the packing is different or involves different particle sizes. In any event, these curves show shock wave pressure measured in kilobars within such materials for velocity measured in kilometers per second. Going now to FIG. 4 of the drawings and describing the velocity of the various components, assume that the blasting cap is detonated and further assume that the pellet 35 is also detonated and forms a flyer of the plate 36 which traverses the gap. As the flyer traverses the gap, and assuming PYX explosive used at 35, the flyer velocity is about 2.7 kilometers per second which defines the point 53 in FIG. 6. The preferred material for the flyer is typically stainless steel or some other high shock impedance material. The flyer impacts against the facing transverse barrier and creates a shock wave. Assuming that the transverse barrier 45 is made of aluminum, this defines a crossing point at 54 which is derived from the relatively high slope line 55 extending from the point 53. The shape of that line is defined by the flyer material; stainless steel is preferred because it has a relatively steep slope. The point 54 provides a pressure within the shock wave of about 400 kilobars. The shock wave then must pass through the aluminum member 45. Thereafter, it enters the explosive pellet 37. It has a lower shock impedance. This traverse through the pivot 37 is represented by the line 56 which provides the intercept point 57 on the curve 52. Thus, the point 57 shows a shock wave pressure of about 280 kilobars. This pressure may be insufficient to initiate very insensitive explosives such as PYX. The shock wave travels through the explosive material until it reaches the reflector 41. At the reflector, the shock wave encounters what is preferably a high shock impedance material; again, stainless steel is one preferred material. On shock wave impingement against this dense material in the explosive material which surrounds the reflector plate 41, the shock wave is reflected back into the explosive material. The shock wave pressure increases, tracing along the line 58 until the intercept 60 is accomplished. The point 60 is on the curve 50. This is a pressure of about 550 kilobars. This occurs at the interface between the PYX and the stainless steel reflector. At that location, the pressure is sufficiently high that PYX initiation does occur, and the cylindrical pellet 37 is detonated. Detonation goes around the embedded plate. In turn, that detonation is coupled into the cord 19. Following the propagation sequence through the materials, detonation is assured notwithstanding the extreme stability of the PYX or other similar explosive materials. Thus, the flyer and reflector plate in conjunction with the extremely stable explosive materials provides a substantially fail safe explosive train.

In particular, the present apparatus can be used in extremely hot and high pressure circumstances normally encountered in very deep producing wells. It is particularly useful to provide for detonation of a set of shaped charges for perforation into the adjacent formations. Moreover, this can be accomplished within a relatively simple structure so that failure of the equipment to operate is held to a minimum. There is, however, one benefit from using PYX or similar explosive materials. Should there be a failure, for instance in the firing pulse generator, and the system does not detonate, the materials in the pellet 37 are generally very safe for subsequent retrieval.

In summary, the present disclosure sets forth a system for detonating many shaped charged connected to a detonating cord and utilizes a mechanism for increasing the shock wave pressure instantaneously occurring within a firing mechanism so that safe operation can be assured. While the foregoing is directed to the preferred embodiment, the scope is determined by the claims which follow.

What is claimed is:

1. An explosive initiator for well borehole use in high temperature and pressure wells where explosive train components come into direct contact with well borehole fluid comprising:

(a) a generally elongated cylindrically shaped housing member having a bore therethrough, and having an upper end and a lower end, said bore having a shoulder in the lower end of said housing member;

(b) an electrical conductor feedthrough connector entering said bore at said upper end of said housing member cooperative with a hermetic seal therebetween;

(c) sleeve means (1) having a generally cylindrical shape with (2) a transverse bulkhead thereacross with (3) a plurality of recessed cavities in said bulkhead for holding plural pellets of secondary explosive at the upper surface of said bulkhead, said bulkhead having upper and lower faces shaped for directing shock waves toward a common region along the axis of the sleeve means (4) chamber means at the lower surface of said bulkhead for holding a specified quantity of initiating compound therein for detonation of transfer of a shock wave across said bulkhead, said sleeve means also having (5) an elongate encircling skirt portion extending from said bulkhead, (6) said skirt portion being sized to fit within said housing member between one end thereof and said shoulder, (7) said skirt portion receiving a terminal end of a detonating cord therein for fixed attachment in said housing member;

(d) skirt crimping means cooperatively joining said sleeve means to the detonating cord therein to position the terminal end thereof for detonation wherein detonation first involves said secondary explosive forming a detonation shock wave crossing said bulkhead to said initiating compound and the terminal end of the detonating cord, (e) an external, encircling, concentrically mounted boot at the lower end of said housing member that seals against fluid intrusion.

2. The apparatus of claim 1 wherein said initiating compound is an explosive material characterized by stability at elevated temperatures above 400° F.

3. The apparatus of claim 1 wherein three cavities are positioned adjacent said bulkhead, said bulkhead further having isolating said cavities on one side thereof, and said bulkhead abutting said initiating compound in said chamber means on the opposite side of said bulkhead.

4. The apparatus of claim 3 wherein said initiating compound is an explosive material characterized by stability at elevated temperatures above 400° F.

5. The apparatus of claim 1 wherein said bulkhead has a shape focusing shock wave passing therethrough so that said initiating compound is exposed to enhanced shock for detonation.

6. The apparatus of claim 5 wherein said bulkhead has upper and lower separated faces and said faces define a concave lens to direct shock waves passing through said bulkhead toward a region enclosing a focal point.

7. The apparatus of claim 6 wherein said bulkhead is positioned adjacent to said initiating compound for detonation.

8. The apparatus of claim 7 wherein said initiating compound is an explosive material characterized by stability at elevated temperatures above 400° F.

9. An explosive initiator for well borehole use in high temperature and pressure wells where explosive train components come into direct contact with well borehole fluid comprising:

(a) a generally elongated cylindrically shaped housing member having a bore therethrough, and having an upper end and a lower end, said bore having a shoulder in the lower end of said housing member;

(b) an electrical conductor feedthrough connector entering said bore at said upper end of said housing member cooperative with a hermetic seal therebetween;

(c) sleeve means (1) having a generally cylindrical shape with (2) a transverse bulkhead thereacross with (3) chamber means at the lower surface of said bulkhead for holding a specified quantity of initiating compound therein for detonation of transfer of a shock wave across said bulkhead, said sleeve means also having (4) an elongate encircling skirt portion extending from said bulkhead, (5) said skirt portion being sized to fit within said housing member between one end thereof and said shoulder, (6) said skirt portion receiving a terminal end of a detonating cord therein for fixed attachment in said housing member;

(d) skirt crimping means cooperatively joining said sleeve means to the detonating cord therein to position the terminal end thereof for detonation;

(e) flyer means adjacent the upper surface of said bulkhead;

(f) an external, encircling, concentrically mounted boot at the lower end of said housing member that seals against fluid intrusion (g) an explosive initiator in said bore above said shoulder and electrically coupled to said electrical conductor feedthrough.

10. The apparatus of claim 9 wherein said explosive initiating compound is selected from ABH, DODECA, NONA, TNTPB, DPO, or HNS.

11. The apparatus of claim 9 wherein said chamber means encloses a reflector plate and said initiating compound forms a solid pellet adjacent thereto.

12. The apparatus of claim 11 wherein said flyer means, said bulkhead and said reflector plate comprise parallel plate members.

13. The apparatus of claim 12 wherein said reflector plate comprises a high shock impedance material.

* * * * *